United States Patent [19]

Kohl

[11] 4,169,363

[45] Oct. 2, 1979

[54] LATCH OPENING MEANS FOR WARP KNITTING MACHINE WITH LATCH NEEDLES

[75] Inventor: Karl Kohl, Obertshausen, Fed. Rep. of Germany

[73] Assignee: Karl Mayer Textilmaschinen Fabrik GmbH, Obertshausen, Fed. Rep. of Germany

[21] Appl. No.: 877,598

[22] Filed: Feb. 14, 1978

[30] Foreign Application Priority Data

Feb. 18, 1977 [DE] Fed. Rep. of Germany ..... 2707028

[51] Int. Cl.[2] ..... D04B 23/00

[52] U.S. Cl. ..... 66/207; 66/111

[58] Field of Search ..... 66/111, 207, 203

[56] References Cited

U.S. PATENT DOCUMENTS

| | | | |
|---|---|---|---|
| 2,043,286 | 6/1936 | Diem | 66/111 |
| 2,461,550 | 2/1949 | Lambach | 66/111 |
| 2,634,547 | 4/1953 | Noe | 66/207 |
| 2,744,398 | 5/1956 | Scheibe | 66/111 |
| 2,810,278 | 10/1957 | Noe | 66/111 X |

FOREIGN PATENT DOCUMENTS

| | | | |
|---|---|---|---|
| 126699 | 1/1902 | Fed. Rep. of Germany | 66/111 |
| 131303 | 6/1902 | Fed. Rep. of Germany | 66/111 |
| 132818 | 8/1902 | Fed. Rep. of Germany | 66/111 |
| 25046 | of 1897 | United Kingdom | 66/111 |

*Primary Examiner*—Ronald Feldbaum
*Attorney, Agent, or Firm*—Omri M. Behr

[57] ABSTRACT

There is provided an improved warp knitting machine utilizing latch needles. The improvement comprises the provision of a latch opening means operating in conjunction with the guide bars. The latch opening means may be brush formed when used with latch needles having extra long latches.

7 Claims, 4 Drawing Figures

LATCH OPENING MEANS FOR WARP KNITTING MACHINE WITH LATCH NEEDLES

BACKGROUND OF THE INVENTION

The invention concerns a warp knitting machine for the preparation of the so-called loop patterns. Such loop patterns are used, for example, in the manufacture of terry toweling in which every second stitch row is lapped in a sling forming pillow weft.

Heretofore the pillow wefts have been pulled by a specially steered hook or what from a construction point of view is substantially simpler by the use of lace needles. The lace needle machine permits only a minor variation in the pattern and precludes the use of jacquard patterning.

SUMMARY OF THE INVENTION

The problem presented by the prior art machines is solved in the present invention by using latch needles equipped with latch opening means. Thus in the apparatus, the latch needles are provided, and opening means for said latch needles are provided on the guide bar superstructure which work together with the latch needle in order to open the latch. Since the pillow weft, for example, is lapped every second stitch row, a thread loop is missing therebetween in the hook portion of the latch needle in order to open the latch for the next lap. The necessary opening of the latch is achieved in the present invention through the agency of the opening means so that it is now possible to utilize the latch needle machine with a great variation in design possibility for the production of loop designs.

The opening means is, viewed from the product side, provided behind the guides and from the point of view of the direction of swing of the guides viewed from the rear, the opening means lies in front of the guides.

In one of the preferred embodiments of the present invention the opening means can be made from a thin strip or tab of metal or synthetic material which is, preferably, formed in a spring-like manner. When utilized with this modification, the latch of the latch needle is somewhat longer than usual so that it is higher than the head portion of the needle and can interact with the opening means during the swing through step.

In another of the preferred modifications the opening means is provided in the form of a brush. In this modification the latch of the latch needle can be the usual length.

BRIEF DESCRIPTION OF THE DRAWINGS

Two modifications of the invention are illustrated in the drawings.

DETAILED DESCRIPTION OF THE DRAWINGS

Figure 1:
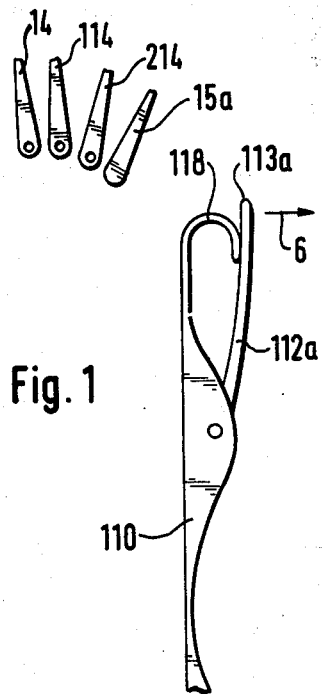
FIG. 1 is a schematic elevational view of a portion of the warp knitting machine in the area of the formation of the stitch showing the tab like latch opening means and the longer latch portion.
Figure 2:
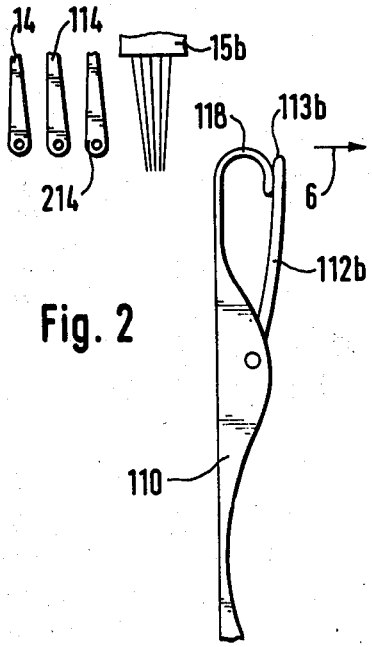
FIG. 2 is an elevational view similar to that of FIG. 1 wherein the opening means is shown in brush form and the latch is of the normal length.

In the embodiment of FIG. 1 the needle 110 is provided with an openable latch 112A which, with respect to the length of said latch is longer than the needle head 118. Behind the guides 114 and 214 attached to the guide bar superstructure there is provided an opening means 15 A in the form of a spring-like tab made of metal or synthetic material. Said tab 15 is oriented in such a manner that during the swing of the guide bar superstructure (not shown) in direction 6 tab 15A contacts the upper end 113A of latch 112A opening the latch. In the example of FIG. 2 the opening means 115B is in the form of a brush. In this modification latch 112B is of the conventional length and its upper end 113B is substantially level with the head 118 of the latch needle 110.

Figure 3:
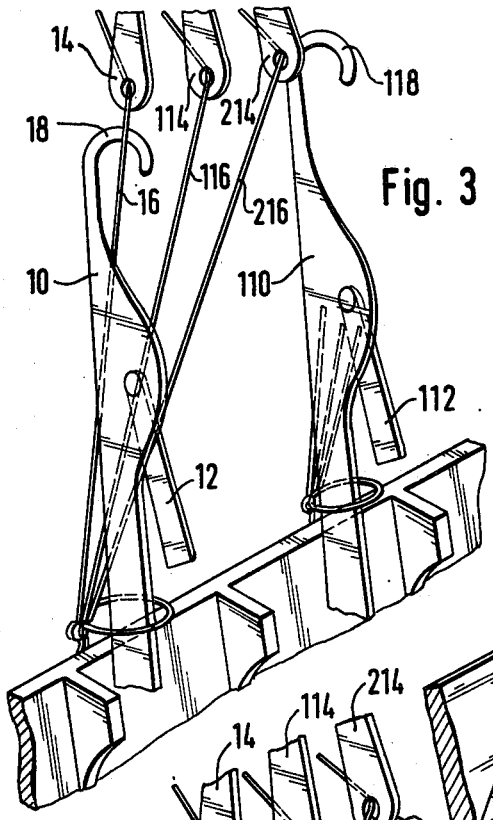
FIG. 3 is a perspective elevational view showing two adjacent latch needles thread guides for one of said needles and the appropriate threads. This is a view of the prior art modifications.
Figure 4:
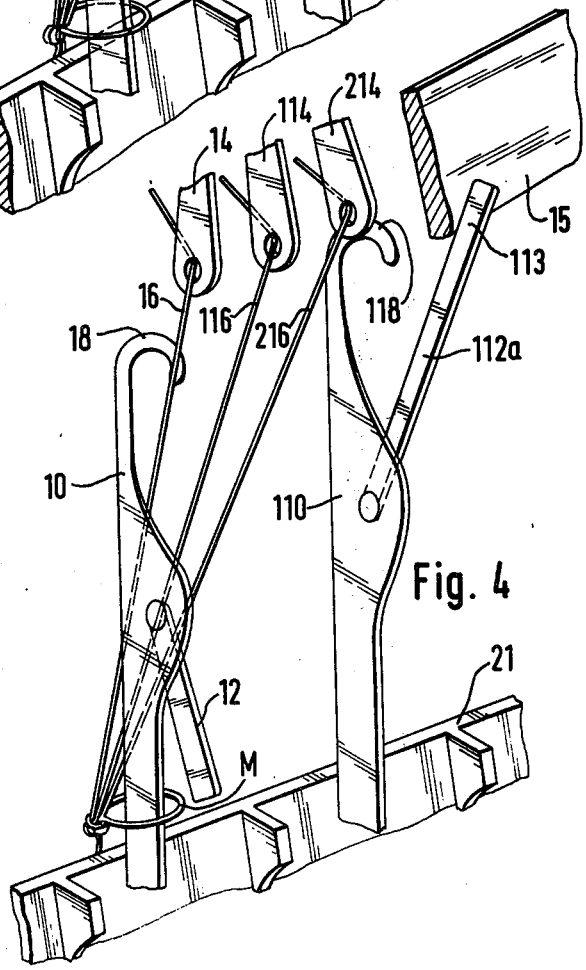
FIG. 4 is an elevational perspective view showing the apparatus of FIG. 3 modified in accordance with the present invention additionally showing the interaction of the latch opening means with a latch of a needle around which no stitch had been lapped.

In FIG. 3 there is shown a conventional latch needle arrangement comprising as shown, latch needle 10 and 110 having latches 12 and 112. Guides 14, 114, 214 having threads 16, 116, and 216 passing there through respectively are conventionally oriented adjacent to needle 10. Similar guides and threads (not shown) are located adjacent to needle 112. In the conventional processes, the loop having been formed in the needle, during the upward movement of needle 10 opens latch 12. Where it is desired to knit material in accordance with a pattern wherein the ground pattern is knitted around every second needle, there is no loop to open the latch of the second needle when such opening is required.

When it is desired to form a pillow weft by knitting, say, thread 216 about needle 110 where needle 110 had not carried a loop in the previous stitch, the latch 112 would still be closed making such an endeavor impossible in the conventional machine.

In the arrangement of the present invention opening means 15 carried in the superstructure of the machine is located adjacent to end 113 of latch 112 so as to interact therewith, thus opening it and permitting the insertion of thread 216 into the hooked portion 118 in order to commence the formation of the pillow weft stitch.

I claim:

1. In a warp knitting machine having at least one guide bar with a plurality of thread guides affixed thereon, a plurality of latch needles, and drive means for moving said needles in an upwardly and downwardly direction and for moving said guide bar in a forwardly and rearwardly direction for the laying of threads when said latch needles are in their uppermost position and said guides are in their forwardmost position, the improvement which comprises latch needle opening means affixed to said guide bars and moving therewith, said latch needle opening means being positioned on said guide bar to come into contact with and open an appropriate latch needle being in its upper position during the movement of said guides to their rearwardmost position.

2. In a warp knitting machine according to claim 1 the improvement wherein said latch needle opening means is disposed between said thread guides and said latch needles prior to the forward movement of the guide bar.

3. In a warp knitting machine according to claim 1 the improvement wherein said latch opening means is a tab fabricated from metallic material.

4. In a warp knitting machine according to claim 1 the improvement wherein said latch opening means tab is fabricated from a synthetic material.

5. In a warp knitting machine according to claims 3 or 4 the improvement wherein said tab has the characteristics of a spring.

6. In a warp knitting machine according to claim 1 the improvement wherein said latch opening means is brush-like.

7. In a warp knitting machine according to claim 6 wherein the latches of said latch needles extend beyond the hook portion of said needles.

* * * * *